US008885004B2

(12) United States Patent
Iguchi

(10) Patent No.: US 8,885,004 B2
(45) Date of Patent: Nov. 11, 2014

(54) ERASING APPARATUS AND METHOD OF ERASING

(71) Applicant: Toshiba Tec Kabushiki Kaisha, Tokyo (JP)

(72) Inventor: Ken Iguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/854,744

(22) Filed: Apr. 1, 2013

(65) Prior Publication Data

US 2013/0293660 A1 Nov. 7, 2013

Related U.S. Application Data

(60) Provisional application No. 61/622,431, filed on Apr. 10, 2012.

(51) Int. Cl.
*B41M 7/00* (2006.01)
*B41J 29/36* (2006.01)

(52) U.S. Cl.
CPC ..... *B41J 29/36* (2013.01); *B41M 7/0009* (2013.01); *B41M 7/009* (2013.01)
USPC ..... 347/179

(58) Field of Classification Search
USPC ..... 347/179
See application file for complete search history.

(56) References Cited

U.S. PATENT DOCUMENTS

| | | | | |
|---|---|---|---|---|
| 2010/0289861 | A1* | 11/2010 | Taguchi | 347/179 |
| 2010/0315475 | A1* | 12/2010 | Taki et al. | 347/179 |
| 2010/0321457 | A1* | 12/2010 | Kawaguchi et al. | 347/179 |
| 2011/0074901 | A1* | 3/2011 | Tsuchihashi et al. | 347/179 |
| 2011/0211033 | A1* | 9/2011 | Yahata et al. | 347/179 |
| 2011/0221848 | A1* | 9/2011 | Taki et al. | 347/179 |
| 2011/0221849 | A1* | 9/2011 | Iguchi et al. | 347/179 |
| 2011/0221850 | A1* | 9/2011 | Kawaguchi et al. | 347/179 |
| 2011/0234735 | A1* | 9/2011 | Taguchi et al. | 347/179 |
| 2012/0038732 | A1* | 2/2012 | Iguchi et al. | 347/179 |
| 2012/0038733 | A1* | 2/2012 | Iguchi et al. | 347/179 |
| 2013/0002782 | A1* | 1/2013 | Kawaguchi et al. | 347/179 |

FOREIGN PATENT DOCUMENTS

| | | | | |
|---|---|---|---|---|
| JP | 07-028352 | | 1/1995 | |
| JP | 2002-082552 | | 3/2002 | |
| JP | 2006-078867 | * | 3/2006 | G01G 21/00 |
| JP | 2008-122520 | | 5/2008 | |
| JP | 2010-243897 | | 10/2010 | |
| JP | 2010-262049 | | 11/2010 | |

* cited by examiner

*Primary Examiner* — Huan Tran
(74) *Attorney, Agent, or Firm* — Patterson & Sheridan LLP

(57) ABSTRACT

An image erasing apparatus includes a heating member and a pressure member positioned adjacent one another, such that a sheet having an erasable image thereon may be passed between the heating member and the pressure member with the pressure member pressing the image on the sheet against the heating member, and a separation member positioned adjacent to the heating member and adjacent to a portion of a transport path of a sheet to be erased in the erasing apparatus.

17 Claims, 4 Drawing Sheets

ERASING APPARATUS AND METHOD OF ERASING

CROSS-REFERENCE TO RELATED APPLICATION

This application is based upon and claims the benefit of priority from U.S. Provisional Application No. 61/622,431 filed on Apr. 10, 2012; the entire contents of which are incorporated herein by reference.

FIELD

Embodiments described herein relate to an erasing apparatus that decolors the color of an image previously made visible by developing a developer having a coloring material therein.

BACKGROUND

There is an erasing apparatus that erases the color of the image by decoloring the color of the coloring material so that the sheet can be reused.

In the erasing apparatus, a developed coloring material is heated so as to reduce the effect of the developing agent on the coloring compound (the precursor compound of the pigment) that generates color by a developing material, thereby eliminating the colored state of the coloring material.

In an apparatus for heating the coloring material, the sheet carrying the coloring material, and the coloring material carried thereon, are conveyed to an erasing region including a heating roller and a pressing roller pressed toward the heating roller for heat treatment. The sheet to be decolored or erased is passed through the nip region of the two rollers, which presses the imaged side of the sheet against the heating roller to "decolor" or erase the image thereon. In this case, in order to prevent the sheet from winding around the heating roller, a separating hook is adopted.

When heated, the sheet that carries the coloring material curls due to the heat imparted thereto during decoloring. When separating hook is adopted to ensure that the sheet does not wrap or wind around the heating roller, to reliably separate a thin sheet or a sheet having color of the image erased therefrom the separating hook has to make contact with the surface of the heating roller. As a result, the coating of the surface of the heating roller becomes scratched, degrading the durability of the heating roller.

The purpose of the present disclosure is to solve the aforementioned problems of the related art by providing an erasing apparatus that decolors the color of the image developed by a developing material, while it maintaining high durability of the heating roller.

DETAILED DESCRIPTION

As an embodiment of the present disclosure, an erasing apparatus includes a decoloring section and a separating section. The decoloring section has a first unit, which has the first heating source in contact with the sheet that carries the image of the color generated by the developing material so that the developing material on the sheet is heated, and a second unit, which has a second heating source in contact with the second surface of the sheet to heat the developing material on the sheet, as a result, the color generated by developing material on either side of the sheet is decolored. A separating section separates the sheet from the heating source, by contacting the sheet at non-image bearing regions of the sheet in at least one of the first unit and the second unit.

In the following, embodiments of the present disclosure will be explained with reference to the drawings.

Figure 1:
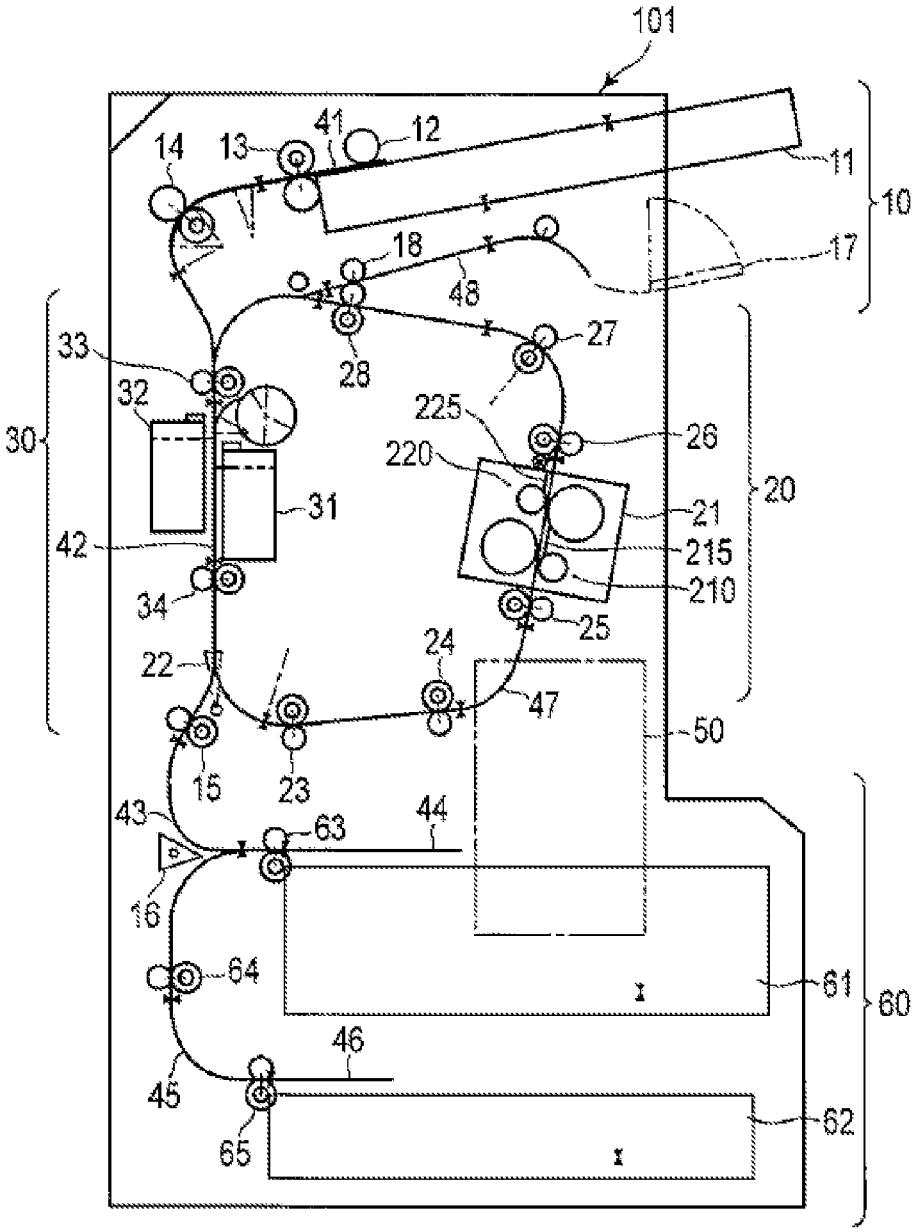
FIG. 1 shows an example of the erasing apparatus of the present embodiment.
Figure 2:
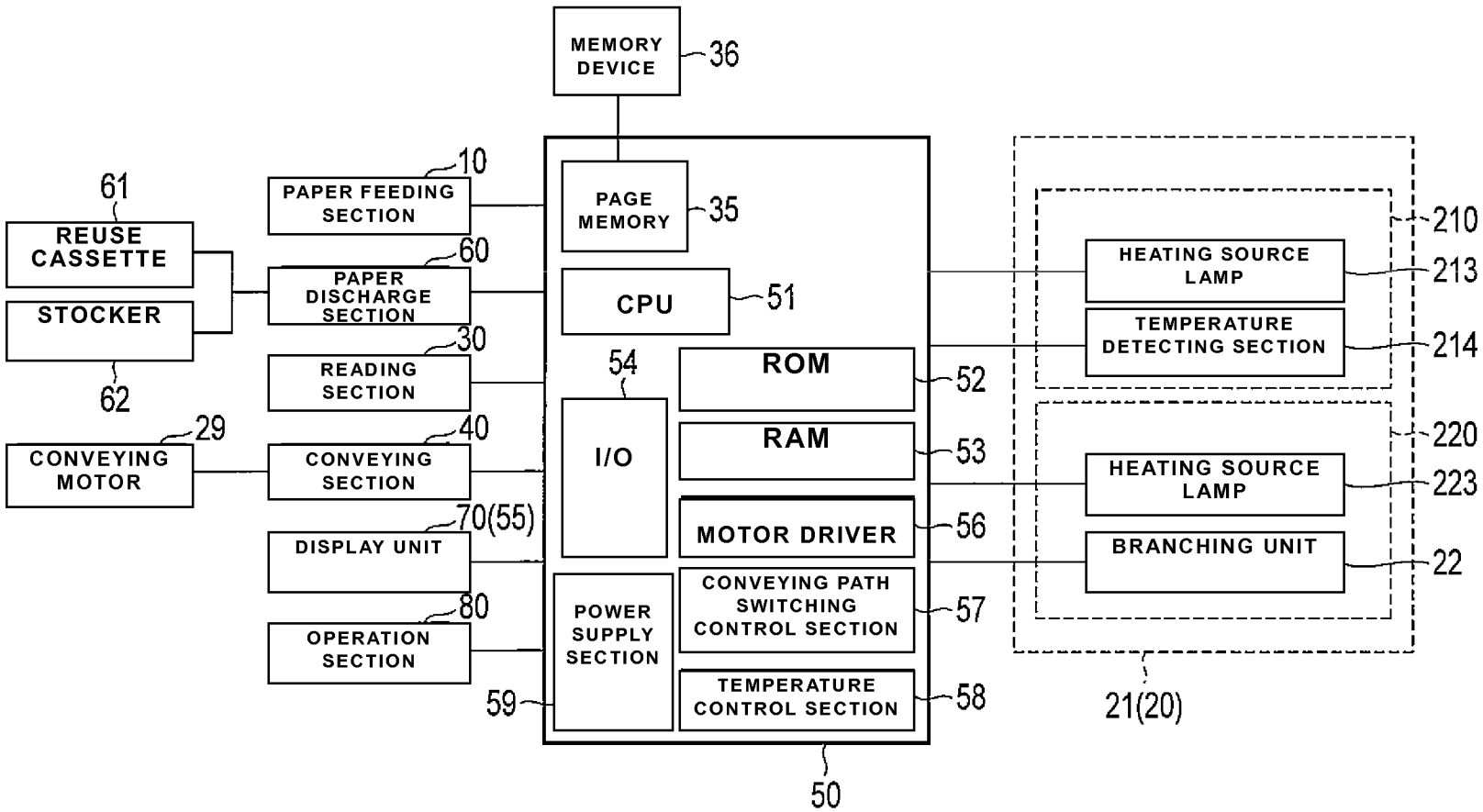
FIG. 2 shows an example of a main section of the erasing apparatus of the present embodiment.

As shown in FIGS. 1 and 2, the erasing apparatus 101 at least contains a paper feeding section 10, an erasing section 20, a reading section 30, a conveying section 40, a decoloring device control section 50, a paper discharge section 60, and a display unit 70 and an operation section 80 shown functionally in blocks on FIG. 2. In addition, FIG. 2 is a block diagram illustrating the main functions of the erasing apparatus 101 in block diagram form. FIG. 1 is a schematic diagram of the erasing apparatus 101 explaining with an emphasis on conveying of the sheet (paper sheet) and the circulation (conveying) of the sheet to the decoloring apparatus.

The paper feeding section 10 at least contains a pre-decoloration sheet holding section (hereinafter to be referred to as paper feeding cassette) 11 that has the pre-decoloration sheets (paper sheets) which may have images (coloring material) to be decolored on the sheets loaded therein (the sheets are set therein), a conveying path 41 (conveying section 40) that guides the pre-decoloration sheet loaded in the paper feeding cassette 11 to the erasing section 20 to be explained in detail later, and a paper feeding roller 12, a conveying roller 13, and a conveying roller 14 that provide the pushing force (conveying force) to the pre-decoloration sheet so that the pre-decoloration sheet can be conveyed (driven to move) in the conveying path 41.

The conveying path 41 is connected to a conveying path 42 (conveying section 40) that partially overlaps and is shared with the reading section 30 to be explained in detail later.

By the conveying path 42 (conveying section 40), a sheet having a decolorable image thereon is guided through the reading section 30, and if an image is present on the sheet, to the erasing section 20 erased (to have the color of the coloring material decolored) in the erasing section 20, and thus guides the sheet after decoloration (hereinafter to be referred to as decolored sheet) again through the reading section 30 and then on to the decolored sheet holding section (hereinafter to be referred to as discharged paper section) 60. The conveying path 42 at least contains conveying rollers 33 and 34 that provide the pushing force that allows the sheet to be conveyed in the conveying path 42 to the pre-decoloration sheet and the decolored sheet, respectively.

The erasing section 20 at least contains a branching unit 22, which branches the pre-decoloration sheet from the conveying path 42 to a decoloring apparatus 21 on the basis of the reading result by the reading section 30, i.e., if an image is present on the sheet, the sheet is fed to the erasing section 2*d*, if an image is not present on the sheet, the sheet is fed to the discharged paper section 60, a conveying path 47 (conveying section 40) that guides the pre-decoloration sheet branched by the branching unit 22 to the decoloring apparatus 21 of the erasing section 20, conveying rollers 23 to 25 that provide a pushing force to the pre-decoloration sheet so that the pre-decoloration sheet can be conveyed to the decoloring apparatus 21, and conveying rollers 26 to 28 that guide the decolored sheet after decoloration by the decoloring apparatus 21 to the conveying path 42. The decoloring apparatus 21 works as follows: a decoloring temperature (heat) over a prescribed temperature is applied on the sheet passing between two rollers arranged with their axes that define their rotating centers substantially parallel with each other, or through the nip region defined by the adjacent portions of one roller and an endless belt, so that the effect of the developing agent on the coloring compound (the precursor compound of the coloring material) which caused the color to be is substantially reduced, and the coloring state is cancelled, that is, the sheet is decolored. Here, the decoloring temperature (heat) is provided by a heat lamp, a heated metal layer on a belt, or an IH (inductive heating) heater that generates heat by inductive heat generated in the metal surface of a roller, or the like. In the following, for the decoloring apparatus 21, a detailed explanation will be made with reference to FIGS. 3 to 5.

Referring still to FIG. 1, the reading section 30 at least contains a first image sensor 31 and a second image sensor 32 that detect whether the sheet going through the conveying path 42 is a pre-decoloration sheet, in other words, the sensors 31 and 32 detect the presence of an image on one or the other sides of a sheet passing there past. The first image sensor 31 and the second image sensor 32 may be sensors for measuring reflection density from the sheet, the dielectric constant or a material passing the sensor, or the like, and thereby detect the presence (or not) of an image on each of the two surfaces of the sheet passing therethrough.

The first image sensor 31 and the second image sensor 32 of the reading section 30 may be CMOS sensors, which acquire the image information of the sheet going through the conveying path 42. The image information acquired by the first image sensor 31 and the second image sensor 32 is stored in a memory device 36. The image information stored in the memory device 36 is subject to A/D conversion (analog/digital conversion), and the converted data are sent to the page memory 35 in page units, i.e., the data is associated with a particular sheet as if passed through the decoloring apparatus.

The conveying path 42 is connected to a conveying path 43, at that the branching unit 22 guides a decolored sheet to the paper discharge section 60, rather than back through the erasing apparatus 20.

The conveying path 43 (conveying section 40) at least contains a discharged paper branching unit 16 and a conveying roller 15. The decolored sheet branched by the branching unit 22 is guided to a first decolored sheet holding section (hereinafter to be referred to as the reuse cassette) 61 or a second decolored sheet holding section (hereinafter to be referred to as stocker) 62 of the paper discharge section 60. A decolored sheet to be placed in the reuse cassette 61 is guided by a conveying roller 63 and a conveying path 44 (conveying section 40). The decolored sheets to be placed in the stocker 62 are guided to the conveying rollers 63 to 65 and conveying paths 45, 46 into the stocker 62, (conveying section 40).

At a prescribed position of the conveying path 42 where the sheet can be fed, such as at the position on the upstream side with respect to the conveying path 41 that conveys the sheet fed by the paper feeding cassette 11 or the conveying path 47 that conveys the decolored sheet after decoloration by the decoloring apparatus 21 to the conveying path 42 with respect to the conveying path 42, a manual conveying path 48 is provided. This manual conveying path contains a conveying roller 18 and a manual paper feeding section 17 to manually feed a pre-decoloration sheet to the decoloring apparatus 21, and then to the erasing section 20, without going through the paper feeding cassette 11.

Referring now to FIGS. 1 and 2, a control section 50 at least contains, for example, a CPU (Central Processing Unit, main controller) 51, a ROM (Read-Only Memory) 52, a RAM (Random Access Memory) 53, an input/output (I/O) port 54, a motor driver 56, a conveying path switching control section (branching unit driving section) 57, a temperature control section 58, and a power supply section 59. Here, the display unit 70 and the operation section 80 are connected to the control section 50. Also, the display unit 70 and the operation section 80 may be made of touch panel or the like formed monolithically.

The main controller (CPU) 51 controls the operation of the various parts according to an operation program stored in the ROM 52.

The ROM 52 holds the operation program for operation of the decoloring apparatus 21 and the reference values for comparing with the results detected by the first image sensor 31 and the second image sensor 32, and the like.

The RAM 53 stores, for example, the results of determining the presence of an image on a sheet detection by the first image sensor 31 and the second image sensor 32 which is input via the I/O port 54, and the input from the jam sensors arranged at the prescribed sites on the various conveying paths 41 to 48 (conveying section 40) via the I/O port 54, and, it stores the temporary data (such as individual data relating to a specific sheet) when the processing routine is executed according to the instruction input (operation information) of the operation section 80, and the like.

The I/O port 54 converts, for example, the detection results of the first image sensor 31 and the second image sensor 32 to a format that can be processed by the CPU 51 (the main control section). Also, the I/O port 54 converts the instruction input from the operation section 80 to a format that can be processed by the CPU 51. Also, the I/O port 54 receives the control instructions to the various elements, such as the paper feeding section 10, the erasing section 20, the reading section 30, the conveying section 40 and the paper discharge section 60, as well as the motor and the branching unit, and the detected values of the various sensors, and the like.

The motor driver 56 drives the rollers of a conveying motor 29 that drives the conveying rollers 23 to 28 arranged before and after (on the upstream side and downstream side) the decoloring apparatus 21, and other motors.

As shown in FIG. 1, the paper discharge section 60 guides a decolored sheet sent via the conveying path 43 via the discharged paper branching unit 16 to the reuse cassette 61 (the first decolored sheet holding section) or the stocker 62 (the second decolored sheet holding section).

The operation section 80 receives control instructions input by the user, and it outputs control commands corresponding to the control instructions so that the CPU 51 can read them.

Figure 3:
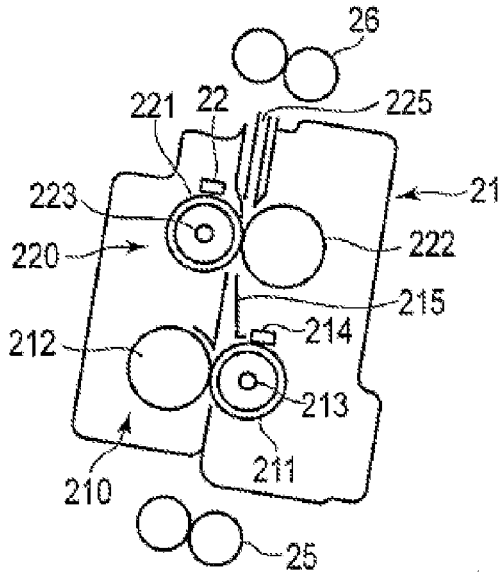
FIG. 3 shows an example of a decoloring apparatus of the erasing apparatus of the present embodiment.

As shown in FIGS. 3 and 4, the decoloring apparatus 21 contains a first heating unit 210 and a second heating unit 220. The side of the second conveying path, that is, the side of the conveying rollers 23 to 25 of the conveying path 47, is called the conveying upstream side. The side of the conveying rollers 26 to 28 of the second conveying path, that is, the conveying path 47, is called the conveying downstream side.

The first heating unit 210 (on the conveying upstream side) includes a heating roller 211 and pressing roller 212. The heating roller 211 has a heating source lamp 213 inside the roller thereof, and a temperature detecting section 214 is located on the outer periphery of the roller.

The second heating unit 220 (on the conveying downstream side) includes a pair of rollers, that is, a heating roller 221 and a pressing roller 222. The heating roller 221 has a heating source lamp 223 inside the roller thereof and a temperature detecting section 224 is located on the outer periphery of the roller.

To prevent wrapping or winding of the sheet around the heating rollers 211 and 221, separating guides 215 are located between the heating roller 211 and the pressing roller 212 of the first heating unit 210 and between the heating roller 221 and the pressing roller 222 of the second heating unit 220. The separating guides 215 guide the paper sheet between the heating roller 221 and the pressing roller 222 of the second heating unit 220, and, at the same time, ensure separation of the sheet from the surface of the heating roller 211 of the first heating unit 210. Also, on the downstream side (the conveying roller 26 side) of the heating roller 221 and the pressing roller 222 of the second heating unit 220, separating guides 225 are arranged to ensure separation of the sheet from the surface of the heating roller 221 of the second heating unit 220.

The heat capacity of the heating source lamp 213 in the heating roller 211 of the first heating unit 210 is nearly equal to the heat capacity of the heating source lamp 223 in the heating roller 221 of the second heating unit 220.

The first heating unit 210 and the second heating unit 220 have the positions of the heating roller 211 and the heating roller 221 inverted from each other with respect to the second conveying path, i.e., the heating rollers 211 and 221 are located to engage opposite sides of a sheet passing through the erasing apparatus 20. In the configuration in the embodiment, the heating roller 211 is in contact with one surface of the sheet passing through the second conveying path (the side on the second image sensor 32 side, to be referred to as the outer surface as needed). Consequently, the heating roller 221 is in contact with the other surface of the sheet passing through the second conveying path (the side on the first image sensor 31 side, to be referred to as the back surface as needed).

The first heating unit 210 or the second heating unit 220 or both of them may have a configuration in which one roller and an endless belt together form a nip. The heating source lamp 213 of the first heating unit 210 or the heating source lamp 223 of the second heating unit 220 may also be replaced by an IH (inductive heating) heater that generates the inductive heat in the metal surface of the heat roller (or the metal layer of the belt).

Figure 4A:
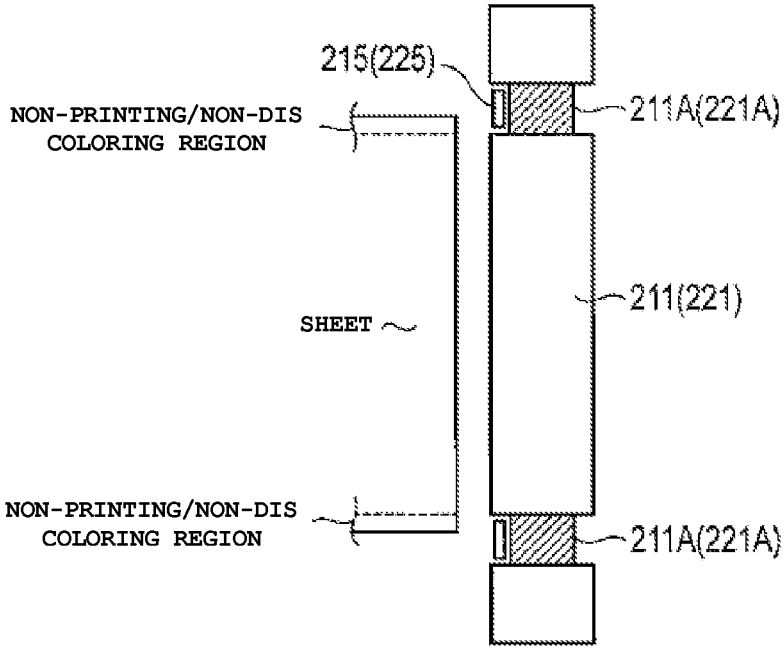
FIG. 4A and FIG. 4B shows an example of the decoloring apparatus of the erasing apparatus of the present embodiment.
Figure 4B:
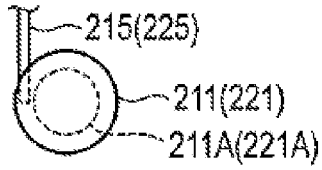

FIG. 4A and FIG. 4B shows an example of a heating roller 211 or 221 of the embodiment. In this example, on the heating roller 211 of the first heating unit 210 or the heating roller 221 of the second heating unit 220, at the sites corresponding to the opposed sides of a sheet to be decolorated, there are provided recesses 211A for receiving the separating guides 215 therein, respectively, or recesses 221A in roller 221 for receiving the separating guides 225, respectively. That is to say, the separating guides 215 extend within the recesses 211A of the heating roller 211 of the first heating unit 210, and the separating guides 225 extend within the recesses 221A of the heating roller 221 of the second heating unit 220. Consequently, the separating guides 215 and the separating guides 225 are located adjacent to the outer diameter of the heating roller or at the positions inwardly thereof.

The recessions 211A or recessions 221A are arranged at the portions on the heating roller 211 (heating roller 221) corresponding to the non-printing/non-decoloring regions of the sheet, where an image is not present or is unlikely to be present. The recessions 211A or the recessions 221A are formed to overlap the sides of a sheet moving therepast by a few mm, e.g., 2 mm, from the end portions in the width direction of the sheet, respectively. Consequently, the separating guides 215 or the separating guides 225 are located at the sites of the recessions 221A or the recessions 221A, and they may contact the sides of the sheet for, e.g., about 2 mm.

Additionally, the separating guides 215 (separating guides 225) are not in contact with the outer surface of the heating roller 211 (heating roller 221) in contact with the main portion of the sheet except the overlap portions at the two ends parallel with the conveying direction of the sheet as the decoloration subject. Consequently, the coating on the surface of the heating roller is not scratched by the separation device. As a result, it is possible to prevent the undesired degradation of the durability of the heating roller 211 (heating roller 221).

Also, the recesses 211A or recesses 221A can be positioned to accommodate sheets of different sizes in the same sequence (sequence A or sequence B) with the following scheme: the interval between them is selected with the following effect: for example, when an A4-size sheet is conveyed, the direction parallel with the minor edge direction is taken as the conveying direction, and, for an A3-size sheet, the conveying direction is taken as parallel with the major edge direction.

Figure 5A:
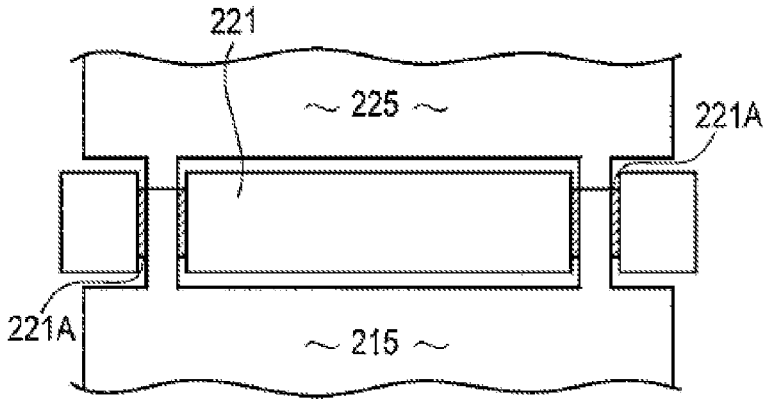
FIG. 5A and FIG. 5B shows an example of the decoloring apparatus of the erasing apparatus of the present embodiment.
Figure 5B:
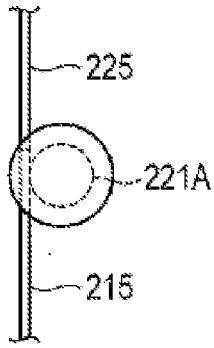

In the example shown in FIG. 5A and FIG. 5B, the separating guides 215 and the separating guides 225 may be formed monolithically on the upstream side and downstream side from the heating roller 211 (heating roller 221).

In the following, the conveying operation will be explained.

In the decoloration and reading mode, the sheet to have the color of the image thereon (the color displayed by the developing material, that is, the coloring material) to be decolored is conveyed from the paper feeding section 10 through the first conveying path, and it is positioned at the reading section 30. In the reading section 30, the first image sensor 31 and the second image sensor 32 read the image information on the sheet. The image information on the sheet read by the first image sensor 31 and the second image sensor 32 is stored in the memory device 36.

The sheet that has passed through the reading section 30 then goes through the second conveying path (conveying path 47), and it is then positioned at the first heating unit 210 of the decoloring apparatus 21 after going through the conveying roller 25 on the conveying upstream side, and, as it goes through the second heating unit 220 on the conveying downstream side, the color of the image is decolored in the decoloring process.

The sheet that has been decolored by the decoloring apparatus 21 then goes through the conveying roller 26 on the conveying downstream side from the second heating unit 220, and it is positioned in the second conveying path. The decolored sheet located in the second conveying path is again positioned in the first conveying path, and it goes through the first conveying path into the first discharged paper tray (reuse cassette) 61 or the second discharged paper tray (stocker) 62 of the paper discharge section 60.

However, when the decoloring process is carried out by the decoloring apparatus 21, for the sheet going from the heating roller 211 and the pressing roller 212 of the first heating unit 210 to the heating roller 221 and the pressing roller 222 of the second heating unit 220, by the separating guides 215 that work together with the recessions 211A on the first heating roller 211, it is reliably separated (peeled) from the first heating roller 211.

Also, a sheet moving downstream from the heating roller 221 and the pressing roller 222 of the second heating unit 220 is reliably separated (peeled) from the second heating roller 221 by the separating guides 225 that work together with the recessions 221A of the second heating roller 221.

Also, as shown in FIG. 5A and FIG. 5B, the separating guides 215 and the separating guides 225 on the upstream side and downstream side of the heating roller 221 of the second heating unit 220 may be formed monolithically, so that it is possible to omit the conveying guides required when they are arranged independently.

Consequently, even for a thin sheet or a sheet that has the color of the image erased, it is still possible carry out separation (peeling) without winding on the heating roller. As a result, it is possible to suppress the undesired degradation in the durability of the heating roller.

For example, by the manual paper feeding section 17, when sheets with different lengths are fed, with the same width of the sheets in the direction orthogonal to the sheet conveying direction, such as in the case of A3-size sheets, the input sheet sizes can be tolerated by the operation section 80. For example, for the length of the sheets, according to the control carried out at the control section 50 corresponding to the input from the operation section 80, control is carried out so that sheet jam (abnormality in conveying) is not detected up to at least twice the length when an A4-size sheet is conveyed. That is, with the erasing apparatus that carries out decoloration treatment for the minor edge direction (lateral direction) of the A3-size sheet, that is, the major edge direction (longitudinal direction) of the A4-size sheet, it is possible to carry out the decoloration treatment also for the A3-size sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing apparatus comprising;

a heating roller and a pressure roller positioned adjacent one another, such that a sheet having an erasable image thereon may be passed between the heating roller and the pressure roller with the pressure roller pressing the image on the sheet against the heating roller, the heating roller including a central portion having a first diameter and opposed reduced diameter portions; and a separation member positioned adjacent to the heating member and adjacent to a portion of a transport path of a sheet to be erased in the erasing apparatus.

2. The image erasing apparatus of claim 1, wherein the separation member is received in a position overlying at least one of the reduced diameter portions of the heating roller.

3. The image erasing apparatus of claim 2, wherein the separation member includes a first portion positioned to overly at least one of the opposed reduced diameter portions of the heating roller and a second portion extending in the direction of the other reduced diameter portion at a location downstream of the feeding direction of a sheet to the heating roller.

4. The image erasing apparatus of claim 2, wherein the separation member is spaced from the reduced diameter portion and inset from the first diameter of the heating roller.

5. The image erasing apparatus of claim 4, wherein the separation member extends from the both reduced diameter portions of the heating roller in a downstream direction of a sheet feed path.

6. The image erasing apparatus of claim 5, wherein the separation member includes a portion extending across the downstream path side of the heating roller.

7. The image erasing apparatus of claim 1, wherein the feed path of a sheet past the heating roller extends over the opposed reduced diameter portions of the heating roller.

8. The image erasing device of claim 1, further including a second heating roller and a second pressure roller disposed in the transport path downstream of the heating roller and pressure roller, a second separation member associated with the second heating roller.

9. A method of erasing an image on a sheet, wherein the image may be rendered visible, and then substantially not visible by a further application of heat thereto, comprising:

providing a heating roller and a pressure roller adjacent to one another to define a sheet flow path therebetween, the heating roller having a continuous contact surface enageable with a sheet and including a first diameter portion and at least one reduced diameter portion; and positioning a separation member adjacent to the sides of the flow path within the width of the sheet flow path, and below the level of the continuous contact surface in a position between the first diameter and the reduced diameter to underlie a side of a sheet to be passed through the space between the heating roller and the pressure roller and extending therefrom in a flow path downstream direction from the heating roller.

10. The method of claim 9, wherein the separation member overlies the reduced diameter portion of the heating roller in the position between the first diameter and reduced diameter of the heating roller, and extends therefrom in a downstream direction of the flow path.

11. The method of claim 10, further including the step of passing a sheet having an image on a first side thereof between the pressure roller and the heating roller, and sliding the paper along the portion of the separation member disposed downstream of the heating roller.

12. The method of claim 11, wherein the second heating roller and the heating roller are positioned to engage against opposed sides of a sheet passing therepast.

13. The method of claim 10, wherein the portion of the separation member extending in the downstream direction of the flow path additionally extends in a direction across the flow path of a sheet.

14. The method of claim 9, further including the steps of providing a second heating roller and a second pressure roller adjacent to one another to define a sheet flow path therebetween, the second heating roller having a continuous contact surface enageable with a sheet that has been previously passed through the heating roller and the first pressure roller.

15. An apparatus for erasing images from sheets, comprising a sheet reader configured to detect the presence or absence of an image on a sheet;

a diverter positioned downstream of the sheet reader configured to select at least an erasing path and a discharge path for a sheet which has passed the sheet reader;

a continuous heating surface located in the erasing path, the continuous heating surface having at least one curved surface diverting in direction from the erasing path;

a pressing surface positioned adjacent to the heating surface to urge a sheet directed to the erasing path against the heating surface; and a separator located adjacent to the heating surface and extending downstream from the heating surface and positioned to limit diversion of a sheet from the erasing path.

16. The apparatus of claim 15, further including:

a second continuous heating surface located in the erasing path, the second continuous heating surface having at least one curved surface diverting in direction from the erasing path;

a second pressing surface positioned adjacent to the second heating surface to urge a sheet directed to the erasing path against the second heating surface.

17. The apparatus of claim 16, wherein the separator extends into a region between the continuous heating surface and the second continuous heating surface.

* * * * *